United States Patent [19]

Merlin

[11] Patent Number: 4,930,706

[45] Date of Patent: Jun. 5, 1990

[54] WATER BROOM

[76] Inventor: Arthur Merlin, 3300 W. Roxboro Rd., Atlanta, Ga. 30324

[21] Appl. No.: 252,157

[22] Filed: Oct. 3, 1988

[51] Int. Cl.[5] ..... B05B 1/20; B05B 15/06; B08B 3/02

[52] U.S. Cl. ..... 239/754; 239/600

[58] Field of Search ..... 239/754, 600

[56] References Cited

U.S. PATENT DOCUMENTS

| | | | |
|---|---|---|---|
| D. 229,932 | 1/1974 | Goodrich | D23/35 |
| D. 243,610 | 3/1977 | Craig | D23/35 |
| D. 244,532 | 5/1977 | Poston | D23/35 |
| D. 250,826 | 1/1979 | Newman | D23/35 |
| D. 277,499 | 2/1985 | Slager | D23/35 |
| 2,150,651 | 5/1935 | Ewing . | |
| 2,746,072 | 5/1956 | Lumpkin . | |
| 2,784,030 | 3/1957 | Dietzel | 239/754 |
| 2,889,994 | 6/1959 | French | 239/754 |
| 3,008,649 | 11/1961 | Bock et al. | 239/600 |
| 3,202,362 | 8/1965 | Wright | 239/754 |
| 3,797,755 | 3/1974 | Saisho | 239/600 |
| 3,913,837 | 10/1975 | Grant | 239/754 |
| 3,931,931 | 1/1976 | Otis | 239/754 |
| 4,003,668 | 1/1977 | Kelly, III et al. | 403/287 |
| 4,022,382 | 5/1977 | Engdahl, Jr. | 239/754 |
| 4,083,495 | 4/1978 | Sharp | 239/754 |
| 4,095,746 | 6/1978 | Anderberg et al. | 239/754 |
| 4,219,161 | 8/1980 | Freissle | 239/600 |

FOREIGN PATENT DOCUMENTS

| | | | |
|---|---|---|---|
| 1120216 | 3/1982 | Canada . | |
| 2242062 | 2/1974 | Fed. Rep. of Germany | 239/754 |

OTHER PUBLICATIONS

Advertisement CAL DAK.

American Water Broom, "Lil Squirt" brochure.

American Water Broom Warranty Instruction Part List.

E-6 Assembly Instructions.

*Primary Examiner*—Andres Kashnikow

*Assistant Examiner*—Karen B. Merritt

*Attorney, Agent, or Firm*—Thomas & Kennedy

[57] ABSTRACT

A water broom having nozzles that are at least partially made of a resilient material to ease removal, installation and alignment. The nozzles, being resilient, may be rotated in the apertures of the header to achieve proper alignment of the individual spray patterns. The nozzles are held in place in the apertures of the header by flanges formed during nozzle manufacture, or by flanges created by deformation of nozzles of tubular shape upon installation in the header.

7 Claims, 2 Drawing Sheets

Fig 1
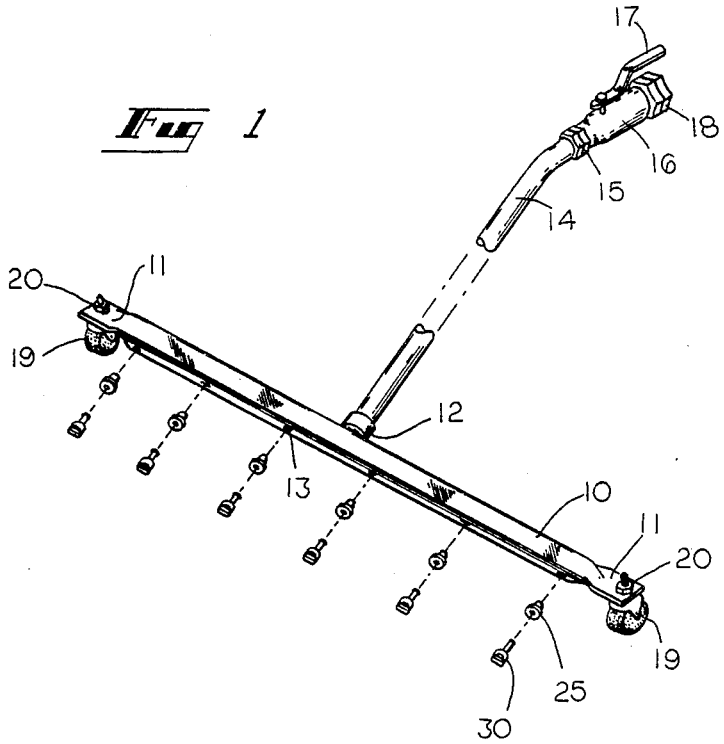
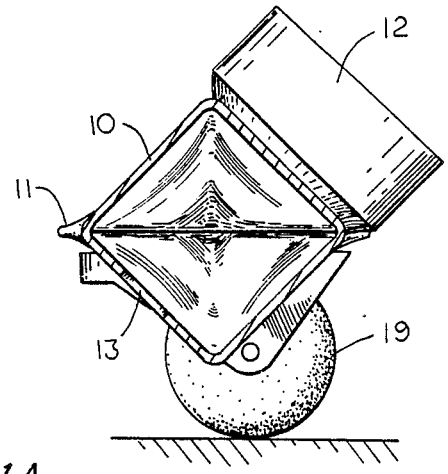
Fig 1A

WATER BROOM

TECHNICAL FIELD

The present invention relates to fluid operated cleaning devices, and, more particularly, to water brooms.

BACKGROUND OF THE INVENTION

Large flat surfaces, such as driveways, side-walks, pool decks, tennis courts and the like, are often difficult to clean quickly. One conventional way of cleaning such surfaces is to use a push broom or sweep broom. Unfortunately, using a conventional broom can be very tiring for the operator, and to remove all of the dirt with a broom, it is often necessary to go back over the area a number of times. Another method that is often employed is to use a spray of water from a garden hose to move the dirt and debris. However, the lone stream from a garden hose cannot clean large areas very quickly. Since neither of these methods has proven efficient for cleaning large flat surfaces quickly, it has been found advantageous to combine elements of a push broom with elements of a water sprayer in a device known as a water broom.

Water brooms conventionally have a water distribution tube, manifold, or header which has an array of nozzles. A handle is mounted to the header, through which water may be delivered to the header. Wheels are provided to keep the header a selected distance from the surface to be cleaned while allowing the operator to move the device over the surface with less effort. The device also has coupling means for connecting the handle to a water hose. The nozzles are arranged so their individual spray patterns overlap to create a wall of high pressure water, and this wall of high pressure water is directed by the operator toward the surface and away from the front of the distribution tube, allowing the operator to propel dirt and debris forward by pushing the handle of the water broom, thereby causing it to move on the wheels or casters. Exemplary of such a water broom is that shown in Canadian Patent No. 1,120,216, of Merlin.

When a water broom is used over extended periods of time, the spray nozzles may become dirty and clogged, thus it is desirable that the nozzles be removable for easy cleaning thereof. Usually, the nozzles are threaded into holes in the header tube. In order that a tight pressure seal may be realized, the threads on the nozzles are tapered, and this has the additional advantage of ensuring that the nozzles do not work loose during operation. The spray nozzle typically has a hollow throat in fluid communication with the water distribution tube, and a spray mouth situated in a slot across the top of the nozzle head. The slot and mouth combine to create a roughly flat stream of high pressure water. The stream actually diverges, but over the short distances involved here divergence is slight, hence this divergent stream will be discussed as a flat stream. This type of spray pattern is an efficient pattern for propelling dirt and debris in that it covers a wide area while delivering the water with sufficient force to cause the dirt and debris to move. Thus, when installing the nozzle, either in manufacturing or in maintenance, it is important to align the slot in the head of the nozzle with the axis of the distribution tube so that all of the slot-shaped orifices of the nozzles are coplanar to create an uninterrupted wall of high pressure water. If the nozzles are not aligned properly, the spray pattern emanating from each may not overlap with the others, leaving gaps in the wall of water and making the water broom less effective. During nozzle installation, as the nozzle is turned and becomes tight in the threads in the header or water distribution tube, care must be taken not to turn the slot of the nozzle past the axis of the distribution tube, for then the nozzle cannot be turned back without loosening it and losing the water tight seal, as well as making it likely that the nozzle will work itself loose during use. Thus once the nozzle has been turned past the axis, it must be turned to the next proper orientation 180 degrees therefrom. If the nozzle were tight in the threads when alignment was overshot, it may break before it can be screwed in another 180 degrees.

Thus there exists a dilemma in the prior art as to whether to provide a water broom with nozzles permanently mounted which cannot be removed for cleaning, but which will remain in alignment, or to provide a water broom with nozzles which may be removed for cleaning, but which may be difficult to install and reinstall properly. Thus, a need has long existed for a water broom with nozzles which may be easily removed for cleaning and yet also easily replaced in proper alignment, while still presenting a water tight seal when installed. It is to this end that the present invention is primarily directed.

SUMMARY OF THE INVENTION

The present invention overcomes the dilemma inherent in prior art structures through the provision of a water broom having nozzles which are made at least partially of resilient material, which, as will be apparent hereinafter, eliminates the necessity of screwing the nozzle into place in the header, and further ensures that a fluid pressure seal obtains regardless of nozzle orientation.

The present invention comprises a fluid spray apparatus, or water broom, which has an elongated header having a plurality of apertures into each of which is mounted a spray nozzle. Each of the spray nozzles has a resilient shank portion which is compressedly seated in its aperture, and a resilient flange portion that abuts a peripheral portion of the interior surface of the header tube about the aperture in pressure sealing engagement. In one preferred embodiment of the invention, each nozzle comprises a resilient outer member and a rigid inner member, and the resilient member has an outside dimension greater than the dimension of the aperture into which it is to be inserted. As a consequence, when the resilient member is forced into the aperture, that portion within the aperture itself is compressed, thereby forming a resilient sealing flange immediately adjacent the aperture on the interior surface of the header.

In a second preferred embodiment of the invention, the entire nozzle is formed of resilient material in which the shank portion is bounded by first and second flange portions which abut both the interior and exterior surfaces of the header in sealing engagement about the aperture.

In both embodiments of the invention, the resilient flange members ensure pressure sealing engagement with the surfaces of the header regardless of orientation of the nozzle, and therefore the nozzle may be adjusted to its desired orientation without affecting the seal. Additionally, the nozzle of the water broom of the present invention does not work loose once it is installed under normal operating conditions.

The embodiments of the present invention represent a significant improvement over the prior art in that the nozzles are capable of being removed, installed and aligned without special tools or techniques. Further, because the nozzles may be removed and replaced by the operator, the nozzles are easier to clean. This is so because a foreign object which may be clogging the nozzle is often best reached from the inside of the nozzle. The resilient nozzles are also less costly to make and install in water brooms, making water brooms more affordable.

BRIEF DESCRIPTION OF THE DRAWINGS

FIG. 1 is a perspective view of a water broom that embodies principles of this invention in a preferred form.

FIG. 1A is a side elevation view of a portion of the water broom with a portion shown in cross section.

DETAILED DESCRIPTION OF THE PREFERRED EMBODIMENT

Figure 2:
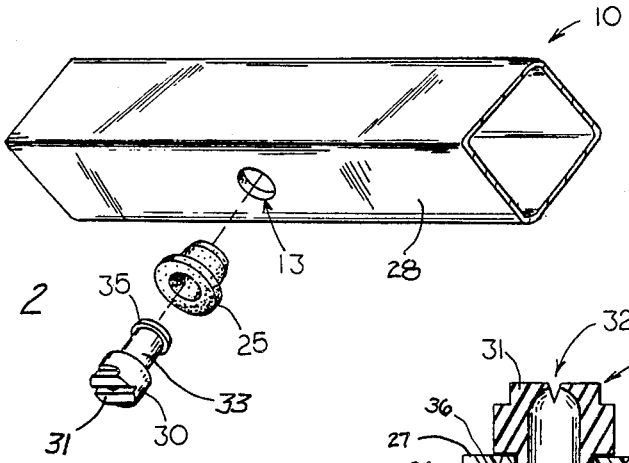
FIG. 2 is an enlarged, exploded view in perspective of a portion of the water broom.

In FIG. 1, there is shown a water distribution tube, manifold, or header 10, having a threaded coupling 12 fixedly attached to the header near the center thereof, a tubular handle 14 fixedly attached to the threaded coupling 12 and in fluid communication with the header 10, and an inlet valve assembly 16, attached to, and in fluid communication with, the handle 14. The inlet valve assembly 16 is attached to the handle 14 by means of a threaded coupling 15, and may be attached to a water hose (not shown) by means of coupling 18. Inlet valve assembly 16 has a valve operating handle 17 for opening and closing the valve.

Referring now to FIGS. 1, 1A and 2, header 10 comprises a hollow tube with crimped flat ends or tabs 11 at each end of the manifold to which casters 19 are attached by means of a threaded stud and nut 20 through a hole in the flat tab 11. The tubing 10 has a square cross section and to form tab 11 it is crimped along a corner. The resulting tab 11 is at an angle of forty-five degrees to each wall of the square tube. Header 10 further contains a series of regularly spaced apertures 13, bored or formed therein, into which nozzle members 25 and 30 may be installed.

Figure 3:
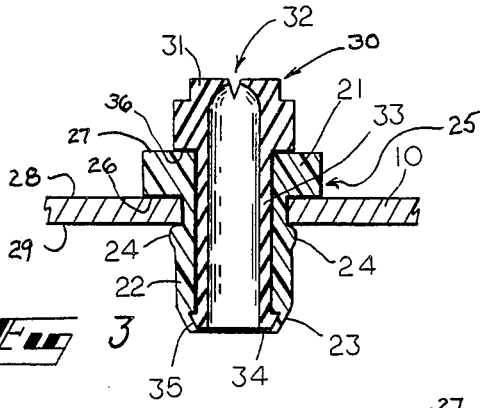
FIG. 3 is a section view of one of the nozzles mounted in the water broom.
Figure 4:
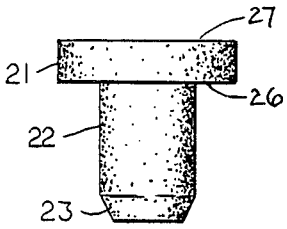
FIG. 4 is a side elevation view of a portion of a nozzle shown detached from the water broom.

Referring now to FIGS. 2, 3 and 4, a two-piece nozzle comprising a resilient member 25 and a rigid member 30 is shown in conjunction with the header 10. Header 10 has a round aperture 13 into which resilient outer nozzle section 25 is inserted. Resilient outer nozzle section 25 is hollow and has a flange portion 21 and a shank portion 22. The outside diameter of the shank 22 is larger than the diameter of the aperture 13 and has a tapered end 23 opposite the flange 21 to facilitate installation. When the shank 22 is installed in the aperture 13, the portion in contact with the cylindrical surface of the aperture 13 is compressed and a bulge or flange 24 in the shank 22 is created adjacent the periphery of the aperture abutting the interior surface 29 of the header 10, securing the shank 22 in place and acting as a pressure seal against fluid loss. Flange 21 of the resilient outer nozzle section 25 has a first planar surface 26 adjacent the shank 22 and a second planar surface 27 on an opposite face of flange 21. When the shank 22 is installed in the aperture 13, the first planar surface 26 of flange 21 abuts in sealing engagement the exterior surface 28 of the header 10. When the nozzle 25 is installed, flange 21 acts as a stop to prevent the nozzle from being pushed too far into the header 10. When the rigid inner nozzle section 30 is then installed in the resilient outer nozzle section 25 in the aperture 13, the outer surface of the shank 33 of the rigid inner member 30 prevents the resilient member 25 from collapsing radially and thus works as an additional means for locking the resilient member 25 in place in the aperture 13. The rigid inner member 30 has a head 31 having a planar surface 36 adjacent the shank 33 and which abuts in sealing engagement the second planar surface 27 of flange 21 of the resilient outer member 25. Head 31 also has an orifice and slot 32 which produce a generally flat spray pattern. The rigid inner member 30 which extends into the resilient outer member 25 is held therein by a flared or barbed flange 35 formed on end 34 of member 30.

Figure 5:
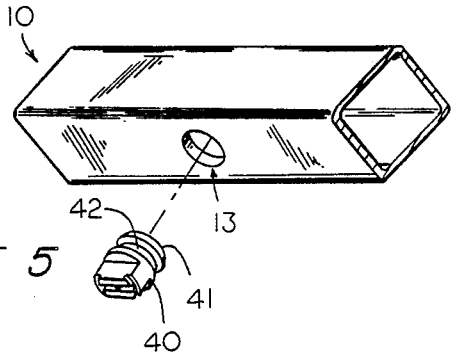
FIG. 5 is an exploded perspective view of a portion of the water broom shown in an alternative form.
Figure 6:
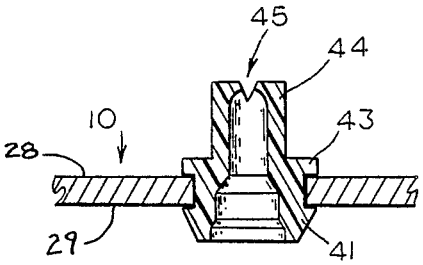
FIG. 6 is a section view of the nozzle of FIG. 5 shown installed.

Referring now to FIGS. 5 and 6 in which another embodiment of the nozzle is illustrated, a one-piece nozzle 40 is shown in conjunction with the header 10. Header 10 has a round aperture 13 into which the resilient nozzle 40 is inserted. Resilient nozzle 40 is hollow and has a first flange portion 41, a shank portion 42, second flange portion 43 and a nozzle head 44. The outside diameter of the first flange 41 is larger than the diameter of the aperture 13. The first flange 41 has a tapered end to ease installation and, once installed, acts to lock the nozzle in place. When the nozzle 40 is installed in the aperture 13, flange 41 contacts the interior surface 29 of the header 10 and acts as a seal against fluid loss, and the shank portion 42 is in annular contact with the cylindrical surface of the aperture 13 and acts as an additional seal against fluid loss. Second flange 43 is in planar contact with the exterior surface 28 of the header 10 and acts as yet an additional seal against fluid loss. Flange 43 also acts as a stop, preventing the nozzle 40 from being inserted too far into the header 10. Nozzle 40 has an orifice and slot arrangement 45 at an exterior end of head 44 for producing a generally flat spray pattern.

OPERATION

In use, the water broom assembly is connected to a source of water pressure, such as an ordinary garden hose, by means of coupling 18. The operator opens the valve 16 by turning the valve handle 17 to the open position, and water under pressure would flow through the valve 16 and into the handle 14. The water continues to flow through the handle 14 and into the header 10, where it is forced out through the two-piece nozzles 25 and 30 or the one-piece nozzles 40. The water coming out of each nozzle creates a wide, generally flat spray pattern directed at the ground immediately in front of the water broom. The nozzles are spaced and aligned in the header 10 so that the individual spray patterns are coplanar and overlap slightly. This overlap creates a wall of high pressure water in front of the water broom. To clean a surface, the operator merely pushes the water broom by its handle 14, the water broom having wheels 19 to allow the water broom to move easily over the surface and to keep the water broom a selected distance from the surface. With casters 19 mounted below to tabs 11, the two walls of the square tube of the header 10 closest to the ground may be maintained at roughly a forty-five degree angle with the ground simply by supporting the handle 14. This keeps the wall of high pressure water at roughly a forty-five degree angle with the ground, which is effective for moving the debris. As the water broom is moved over the surface, the wall of high pressure water forces dirt and debris on the surface to move forward ahead of the water broom.

In the embodiment of FIGS. 2–4, to remove the nozzles 25 and 30 for cleaning, the operator simply grasps the rigid inner member 30 with a pair of pliers or by hand and pulls it out. Once the rigid inner member 30 is removed, the resilient outer member 25 may be removed by hand. After the nozzles have been cleaned, they may be reinstalled by wetting the outer surface of the shank 22 of the resilient outer member 25, and pressing the resilient outer member 25 into the aperture 13 and then pressing the rigid inner member 30 into the resilient outer member 25. Once installed, the nozzles may be aligned by turning the slot 32 in the head 31 of the nozzle with a flat screwdriver until the slot 32 is parallel with the axis of the header 10.

In the embodiment of FIGS. 5 and 6, to remove the nozzles 40 for cleaning, the operator simply grasps the resilient nozzle 40 with a pair of pliers or by hand and pulls it out. After the nozzles have been cleaned, they may be reinstalled by wetting the outer surface of the shank 42 and the flange 41 of the nozzle 40, and pressing the resilient nozzle 40 into the aperture 13. Once installed, the nozzles can be aligned by turning the slot 45 in the head 44 of the nozzle with a flat screwdriver until the slot 45 is parallel with the axis of the header 10.

It will thus be seen that the present invention comprises an effective and useful apparatus for cleaning flat surfaces, and which is easily cleaned and maintained. While the invention has been herein shown and described in what is presently believed to be the most practical and preferred embodiments thereof, it will be apparent that many modifications within the scope of the invention are possible, which scope is to be afforded the broadest possible interpretation, so as to encompass all equivalent structures. For example, it is possible to use apertures with a square shape, rather than a round shape, and to match the exterior shape of the nozzles accordingly. Additionally, while the foregoing has disclosed water as the cleaning fluid, other fluids may be used depending upon the particular application. Further, while the present invention has been disclosed as having a square header tube with crimped ends, it is possible to use other tubing shapes such as round, other means for sealing each end, such as welding, or other methods of attaching casters, like clamping.

What is claimed is:

1. A water spray apparatus comprising an elongated header of square tubing comprising four substantially flat walls and having ends which are crimped along a diagonal of the square to form generally flat end portions, said header having a plurality of apertures communicating between an interior and an exterior surface of one of said flat walls of said header; a tubular handle mounted to a flat wall of said header opposite said one wall in fluid communication with said header for grasping by an operator in an inclined attitude which usually orients the apertures downwardly toward the ground surface and the flat end portions of said header approximately parallel to the ground surface; a coupling means for coupling a water hose to said tubular handle; a wheel mounted to each of said flat end portions of said header and positioned below said flat end portion for movably supporting said header on the ground surface; and a nozzle mounted to said header in each of said header apertures, wherein each of said nozzles has a generally slot-shaped outlet for producing a generally flat fluid spray pattern, a resilient shank portion compressedly seated in said aperture, and a resilient flange portion that abuts in sealing engagement a peripheral portion of the interior surface of said one wall of said header about said aperture.

2. An apparatus as claimed in claim 1 wherein each of said nozzles each has at least one resilient flange portion that abuts in sealing engagement a planar portion of the exterior surface of said one wall of said header about said aperture.

3. An apparatus as claimed in claim 1 wherein each of said nozzles consists essentially of a resilient material.

4. An apparatus as claimed in claim 2 wherein said nozzles comprise a resilient outer member and a rigid inner hollow member.

5. An apparatus as claimed in claim 4 wherein said rigid inner hollow member has at least one rigid flange portion that abuts in sealing engagement a planar surface of said resilient flange opposite said header, about said aperture.

6. An apparatus as claimed in claim 1 wherein said nozzles comprise a resilient outer member and a rigid inner hollow member in said outer member, and means for retaining said inner member within said outer member.

7. An apparatus as claimed in claim 1 wherein said rigid inner hollow member has at least one rigid flange portion that abuts in sealing engagement a planar surface of said resilient flange opposite said header, about said aperture.

* * * * *